US006001144A

United States Patent [19]

Takeuchi et al.

[11] Patent Number: 6,001,144

[45] Date of Patent: Dec. 14, 1999

[54] WASTE TREATMENT PROCESS

[75] Inventors: Yoshiyuki Takeuchi, Hiroshima-ken; Akira Satou, Yamaguchi-ken, both of Japan

[73] Assignee: Mitsubishi Jukogyo Kabushiki Kaisha, Tokyo, Japan

[21] Appl. No.: 09/124,578

[22] Filed: Jul. 29, 1998

Related U.S. Application Data

[63] Continuation-in-part of application No. 08/790,441, Jan. 29, 1997, abandoned.

[30] Foreign Application Priority Data

Jan. 29, 1996 [JP] Japan ..... 8-012794

[51] Int. Cl.[6] ..... C10L 3/00

[52] U.S. Cl. ..... 44/605; 44/606; 48/209; 48/197 R; 585/240; 585/241; 585/242

[58] Field of Search ..... 44/605

[56] References Cited

U.S. PATENT DOCUMENTS

| | | | |
|---|---|---|---|
| 3,890,432 | 6/1975 | White | 423/655 |
| 4,160,663 | 7/1979 | Hsieh | 75/35 |
| 4,212,452 | 7/1980 | Hsieh | 266/156 |
| 4,274,839 | 6/1981 | Leas | 48/202 |
| 4,544,374 | 10/1985 | Mallek et al. | 48/114 |
| 4,618,735 | 10/1986 | Bridle et al. | 585/240 |
| 5,104,419 | 4/1992 | Funk | 48/209 |
| 5,339,621 | 8/1994 | Tolman | 210/769 |
| 5,534,659 | 7/1996 | Springer et al. | 588/227 |
| 5,731,483 | 3/1998 | Stabel et al. | 585/241 |

FOREIGN PATENT DOCUMENTS

| | | |
|---|---|---|
| 0648829 | 4/1995 | European Pat. Off. . |
| 0676464 | 10/1995 | European Pat. Off. . |
| 2721689 | 12/1995 | France . |

*Primary Examiner*—Ellen M. McAvoy
*Attorney, Agent, or Firm*—Michael N. Meller

[57] ABSTRACT

A process of gasifying waste containing organic substances which may be combusted or gasified by means of partial oxidation in the presence of air or oxygen and steam. The gasification process includes the step of adjusting the molar ratio of steam/carbon ($H_2O/C$) for supplied steam and the organic substances containing carbon to a desired ratio. The process continues with partial oxidation at about 700° C. to about 900° C. and discontinuing the steam supply while continuing only air or oxygen supply to combust the remaining combustibles having carbon as their major component.

10 Claims, 4 Drawing Sheets

■ UNREACTED CARBON RESIDUE
▲ HEAVY HYDROCARBON PRODUCT
● CLEAN GASIFICATION

WASTE TREATMENT PROCESS

This is a continuation-in-part of U.S. patent application Ser. No. 790,441, filed Jan. 29, 1997, now abandoned.

The present invention relates to a waste treatment process. More particularly, the present invention relates to a process of gasifying waste containing organic substances by means of partial gasification and combusting the gases and residue from gasification.

BACKGROUND OF THE INVENTION

Conventionally, in the treatment of waste containing organic products such as wood, agricultural products (e.g., sugarcane, corn), general plants (e.g., algae, grass), such products have been gasified for processing. Recently, another gasification technology has been developed for processing industrial waste having, as a major constituent, an organic substance such as plastic, recycled paper, and so-called "shredder dust." "Shredder dust" results from plastics used in automobiles that are scrapped and shredded, and from fiber-reinforced plastic (FRP) ships whose major constituent is a thermoplastic resin.

In the treatment of waste by gasification of these organic substances, a thermal decomposition furnace or combustion furnace of one-level-moving or fluid-bed type in the presence of air or oxygen is generally used. Collecting the resulting waste heat is the major process. Recently, a technology for waste containing plastics has been developed to undertake thermal decomposition and to collect oil components (hereafter referred to as the thermal decomposition method).

Also in the "fixed floor method," the two-level type described below (hereafter referred to as the air decomposition method) is employed. That is (1) in the first-level operation, the air supply is controlled within the range of about 400° C. to about 800° C. to decompose components for which controlled decomposition is easy; while (2) in the second-level operation, any remaining uncombusted carbon components (coke, charcoal, etc.) are combusted in the presence of oxygen at high concentrations for combustion enhancement and the like to maintain the temperature within the range of about 800° C. to about 1200° C.

The above-mentioned conventional methods have the following problems.

(1) Thermal Decomposition Method (a) Plastics: Because a plurality of materials coexist in plastics, undertaking the process in the wide range of temperatures from about 300° C. to about 800° C. is difficult. Also, problems arise because soot is generated and coking carbon is deposited on the walls of the equipment. In addition, thermal decomposition oil is of poor quality because it contains uncombusted carbon, which limits the use of the oil to a low-quality fuel.

(b) Wood, Agricultural Products, General Plants (e.g., algae, grass), and so forth: This process produces about 40% to about 60% residual carbon. In addition, thermally combusted gases contain a large amount of carbon dioxide ($CO_2$), so that the gases are not able to be used as fuel gases.

(c) Shredder Dust: Shredder dust has the same problems as noted above for plastics.

(2) Air Combustion Method (a) The major components of the combusted waste gas are nitrogen ($N_2$) and carbon dioxide ($CO_2$), which generate a low level of heat so that the gas cannot be used as a fuel.

(b) The incomplete combustion produces soot or nitrogen oxide ($NO_x$) as a by-product and further generates dioxins providing a secondary pollution.

(c) Plastics, particularly those which go to above 1200° C. during combustion, tend to damage the walls of a combustion furnace.

To overcome these problems, the inventors previously filed a patent application (Japanese Patent Application [Tokugan] H5-290349), laid open on May 30, 1995, in which they proposed a process of gasifying waste containing organic substances which may be combusted or gasified by means of partial oxidation in the presence of air or oxygen and steam. In this process, the gasification includes the step of adjusting the molar ratio of steam/carbon ($H_2O/C$) for the supplied steam and the organic substances containing carbon to be between about 1 to about 10, the step of partial oxidation at about 700° C. to about 900° C.

According to the aforementioned Japanese Patent Application (Tokugan) H5-290349, clean or gasified gases with low soot or tar content can be obtained. However, when this process is applied to waste containing organic substances, specifically to waste having those components which are difficult to gasify, a high gasification efficiency may be difficult to obtain. This results in problems such as leaving residues having unreacted carbons as a major component and the like. The present invention resolves these problems and provides a gasification process for waste containing organic substances without discharging soot or tar from the carbon residue or from incomplete combustion outside of the system. Furthermore, the process efficiently collects heat energy.

SUMMARY OF THE INVENTION

It is accordingly an object of the present invention to provide a process which overcomes the aforementioned problems.

The present invention is directed to a waste treatment process for gasifying waste containing organic substances. The process includes the following steps: supplying steam and air or oxygen to the waste to be treated; partially oxidizing any portion of the waste which is easily thermally decomposed in the presence of the steam; and discontinuing the supply of steam while continuing to supply air or oxygen to combust the remaining combustibles having carbon as their major component.

In a further version ofthe process incorporating the principles ofthe present invention, the partial oxidation is carried out by heating the waste at a desired temperature.

The process incorporating the principles of the present invention also includes a waste treatment process for gasifying waste containing organic substances which may be combusted or gasified by partial oxidation in the presence of air or steam. The process includes the following steps: supplying steam and air or oxygen to the waste to be treated; adjusting the molar ratio of steam/carbon ($H_2O/C$) for the supplied steam and the organic substances containing carbon to be substantially between 1 and 10; partially oxidizing the organic substances at a temperature substantially between 700° C. and 900° C.; and discontinuing the supply of steam while continuing to supply air or oxygen to combust the remaining combustibles having carbon as their major component.

The present invention is also directed to a waste treatment process which includes the step of combusting any flammable gases generated during the gasification in the presence of air or oxygen.

In addition, according to the present invention, a waste treatment process is carried out wherein the step of combusting the generated flammable gases is carried out in a separate environment from that ofthe partial oxidation and steam discontinuation steps.

It is another object of the present invention to efficiently gasify and combust the organic substances in waste, to produce high quality gases, to prevent the production of soot from unreacted carbon residue or incomplete combustion during gasification or combustion, and to collect energy at high efficiency for other uses, as follows:

(i) Gasification employs a two-step process: The components which are quickly gasified are gasified at a lower temperature in the first step of the process, while the components which are gasified slowly are combusted in the second step of the process.

(ii) Air or oxygen is used as an oxidizer.

(iii) In the first step of the process, a partial oxidation takes place in a steam environment.

(iv) In the first step of the process, the molar ratio of steam/carbon ($H_2O/C$) between the supplied steam and carbon in waste is between about 1 to about 10.

(v) In the second step of the process, the steam supply is discontinued and the remaining flammable components are combusted.

(vi) The tar component or soot produced during the aforementioned first and second steps of the process is combusted at a high temperature in a third step of the process. However, this third step occurs at a different place from that of the first and second steps.

(vii) The gas produced in the first step ofthe process contains a large amount of hydrogen ($H_2$), carbon monoxide (CO), and so forth. Therefore, it can be used as a fuel for a gas turbine or as a material for synthesizing methanol.

DESCRIPTION OF THE INVENTION

Figure 1:
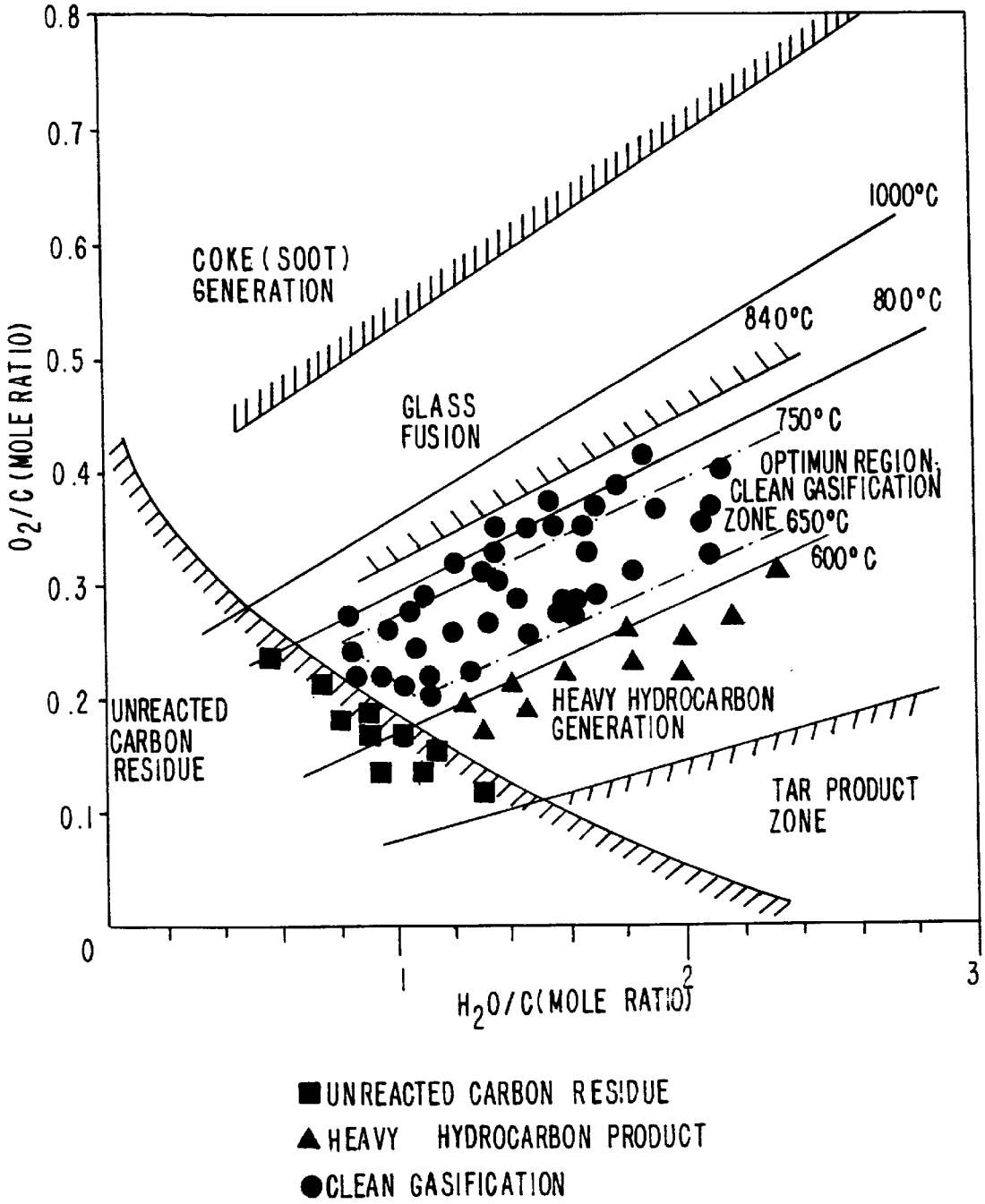
FIG. 1 shows the FRP gasification properties.

When heating plastics, for example, decomposition begins with the side chains having a weak bonding force. Then decomposition begins with single carbon (—C—) bonding followed by the double carbon (—C═) bonding and aromatic compounds, respectively. When the heating is finished, the component which is only slightly thermally decomposed, is left as an uncombusted carbon component. Plastics include thermoplastic resins (polyethylene, polypropylene, etc.) which are easily thermally decomposed and thermosetting resins (fiber-reinforced plastic, unsaturated polyester, etc.) which are only slightly thermally decomposed. In addition, the thermal decomposition or the burning rate of carbon left from a thermal decomposition of wood is tens to hundreds of times slower than that of plastics. As described above, components which have widely varying burning rates with respect to gasification or combustion coexists in waste.

The tar component or so-called soot is produced in the early stages of gasification or combustion. Therefore, the process incorporating the principles of the present invention employs the two-step method mentioned above. That is, the portion which is easily thermally decomposed is partially oxidized in the presence of steam in the first step ofthe process. Then, the remaining uncombusted carbon component is burned at a high temperature. When the waste does not contain a component which is difficult to gasify, the second step of the process may be omitted. These operations are described herein.

(1) The First Step of the Process: In the first step of the process, the component which is easy to turn into gas is gasified. At this time a reaction temperature is maintained by partial combustion.

(a) Partial Oxidation: Conventionally, a large amount of air (or oxygen) in excess ofthe theoretical oxygen amount is used in combustion as an oxidizer. In this case, when oxygen in air reacts with an organic substance and burns it (oxidizes), the rate of combustion in oxygen is very fast, burning first the surface of the organic substances consuming oxygen. The rate of oxygen diffusion into the surface area of organic substances is too slow to make up for the oxygen consumed for combustion. As a result, nitrogen is left on the surface of the organic substance and apartial oxygen shortage occurs. The surface of the organic substance reaches a high temperature when it is combusted in the presence of oxygen but the combustion reaction does not occur because ofthe oxygen shortage, accelerating the condensation reaction for carbon substances. As a result, soot is produced. With the presence of chlorine (Cl) in a burning gas, the soot reacts with chlorine producing toxic dioxins as a by-product. $NO_x$ is produced as well because of the oxygen shortage.

These undesirable side effects can be substantially reduced by employing a controlled combustion method, which maintains a constant reaction temperature by means of a so-called partial oxidation reaction. Nonetheless, even with such controlled combustion, when the surface of a flammable component is microscopically viewed, it can be seen that too much oxygen exists thereon, creating hot spots in part and generating soot. Therefore, simply using a controlled combustion method is not sufficient to resolve these problems.

(b) Combining Oxidation Reaction and Water-Gas-Shift Reaction: The oxidation reaction (Reaction 1) is an exothermic reaction while the water-gas-shift reaction (Reaction 2) is an endothermic reaction. Combining the two reactions provides a mild reaction, preventing the oxidation from generating soot mentioned in the partial oxidation step above and $NO_x$.

Reaction 1: Oxidation Reaction $$C+O_2 \rightarrow CO_2 \quad (1)$$

$$C+H_2O \rightarrow CO+H_2 \quad (2)$$

In addition, mixing steam and oxygen prevents the oxygen from being highly concentrated on the surface ofthe flammable component in part. This consequently prevents the surface from having high temperature spots and produces a mild oxidation reaction.

(c) Adjusting Molar Ratio for Steam and Carbon (C) in Waste: As noted above, the partial oxidation is an exothermic reaction while the water-gas-shift reaction is an endothermic reaction. Therefore, increasing the amount of added steam ($H_2O$) increases the amount of heat absorbed. When the amount of heat absorbed is larger than the heat generated by the oxidation reaction, the temperature goes down.

An appropriate temperature range exists for gasification for the following reasons: (1) at a temperature lower than about 700° C., unreacted substances turn into tar as a by-product; (2) at a temperature higher than about 900° C., soot is produced due to the delay in oxygen diffusion for making up the consumption needed for condensation and polymerization or combustion which occurs due to the rapid rise in temperature.

Therefore, an appropriate range exists for the steam/carbon ($H_2O/C$) ratio to maintain an appropriate gasification temperature. This range would be from about 700° C. to about 900° C.

The appropriate steam/carbon ($H_2O/C$) value can vary depending on the type of organic substances. For example, compared to an organic substance such as polyethylene or polypropylene which does not contain oxygen, polyurethane, bio, or paper which contain much oxygen requires a much larger amount of steam ($H_2O$). However, in the case of fiber-reinforced plastics which has a large ash content (inorganic component), a small amount of steam ($H_2O$) is required (see Table 1 below).

In calculating equilibrium, it is preferable that the appropriate range for the steam/carbon ($H_2O/C$) ratio is from about 1 to about 5. However, in general, a steam/carbon ($H_2O/C$) ratio (molar ratio) of about 1 to about 10 is used considering the low steam ($H_2O$) efficiency provided by the blowby which exists in the topography of a gasification furnace (fluid bed, jet flow, kiln, moving bed, etc.).

In addition, when producing carbon monoxide (CO) in Reaction 3 below, by perfectly combusting the carbon (C) in organic substances without generating carbon dioxide ($CO_2$) or controlling the combustion Reaction 4 of hydrogen ($H_2$), only a small amount of steam ($H_2O$) needs to be added.

Reaction 2

$$C+0.5O_2 \rightarrow CO \quad (1)$$

$$H_2+0.5O_2 \rightarrow H_2O \quad (2)$$

In this case, the range for the steam/carbon ($H_2O/C$) ratio of about 1 to about 5 is preferable.

TABLE 1

| Organic Element Analysis (Weight Percent) | | | | | |
|---|---|---|---|---|---|
| Example of Organic Substance | C | H | O | N | Ash/Water |
| Polyethylene | 85.7 | 14.3 | 0.0 | 0.0 | 0.0 |
| Polypropylene | 85.8 | 14.2 | 0.0 | 0.0 | 0.0 |
| Polyurethane | 57.9 | 7.9 | 28.1 | 6.1 | 0.0 |
| FRP* | 50.4 | 4.4 | 7.5 | 0.0 | 37.7 |
| Kolian | 42.5 | 5.7 | 41.4 | 0.0 | 10.4 |
| Paper | 36.5 | 5.0 | 40.9 | 0.0 | 17.6 |

*FRP is a glass fiber-reinforced plastic material found on fishing boats, including scrapped fishing boats. It contains approximately 30–40 wt % glass. The melting point of the glass is approximately 780° C.

(2) The Second Step of the Process: In the second step of the process, the steam supply is stopped and the remaining flammable components are burned in the presence of air or oxygen. In this step, the higher the oxygen concentration, the faster the rate of combustion. The burning temperature is about 800° C. to 1000 ° C. The same furnace used in the first step of the process (gasification furnace, combustion furnace) may be used in this second step. Note that when there are only a few flammable components remaining (incomplete combustion components), there will be little heat provided by combustion. Another method for maintaining the combustion temperature, for example, use of a burner as an additional fueling source, may be required.

(3) The Third Step of the Process: The small amount of tar or soot produced during the first and second steps of the process mentioned above is combusted at a high temperature using gasified gas generated in the first step of the process for the third step of the process. However, this third step takes place in a different environment, at a different place (in different equipment) from that in which the first and second steps have taken place. In order to prevent producing a toxic by-product such as dioxin, burning tar or soot at a high temperature is required. The preferable burning temperature for this purpose is about 1000° C. to about 1300° C.

In the above-mentioned second and third steps, energy can be collected occasionally. Since the process according to the principles of the present invention, in the first step gasifies only the waste component which easily thermally decomposes, a relatively clean gas can be obtained. When waste is gasified with only steam and oxygen, a gasified gas generating a large amount of heat can be obtained, thus making the heat energy collection easier in the third step of the process.

The effects of the process according to the principles of the present invention can best be explained by referring to the following examples.

EXAMPLE 1

A gasification and combustion test was carried out using polyethylene. The specification of the gasification furnace and the gas combustion furnace is noted in Table 2; the operating conditions and test results are shown in Table 3.

Note that in the third step of the process, a gas combustion furnace is formed on top of the gasification furnace to burn flammable gas containing tar and soot components. It is apparent from the results shown in Table 3 that polyethylene leaves no unreacted carbon, providing easy gasification. The waste processing is undertaken only by combusting a gasified gas containing a small amount of tar or soot.

TABLE 2

| | | |
|---|---|---|
| Gasification Furnace | Horizontal Cylinder | ID 100 × 1,500 H (mm) |
| Gas Combustion Furnace | Vertical Cylinder | ID 100 × 1,000 H (mm)<br>A kerosene burner installed |

TABLE 3

First Step (Operating Conditions)

Material: Polyethylene 100 g/h
$H_2O/C$ = 1.3 (molar ratio)
$O_2$ Supply: $O_2/C$ = 0.5 (molar ratio)
Gasification Conditions: 745° C.; 1 atm; Process Time 18 minutes (Results)

Produced Gas: 481 (NL/h)
Gas Composition (volume %): $H_2$ = 61; CO = 17; $CO_2$ = 17; $CH_4$ = 5
Gasification Ratio = 100%

Second Step

No testing required because there was no residue from the first step.

Third Step

Combustion Condition: 1,015° C.

EXAMPLE 2

Using the same equipment as in Example 1, gasification and combustion were tested for FRP (as shown in Table 1 above). The gasification conditions and test results are shown in Table 4. It is apparent from Table 4 that FRP which is a thermoplastic is difficult to gasify completely. However, by combusting the residue in the second step of the process, such residue is rendered harmless.

TABLE 4

First Step (Operating Conditions)

Material: FRP 100 g/h
$H_2O/C$ = 1.3 (molar ratio)
$O_2$ Supply: $O_2/C$ = 0.3 (molar ratio)
Gasification Conditions: 782° C.; 1 atm; Process Time 15 minutes
(Results)

Produced Gas: 141 (NL/h)
Gas Composition (volume %): $H_2$ = 40; CO = 5; $CO_2$ = 53; $CH_4$ = 2
Residue from Incomplete Combustion: 4 g
Second Step Steam supply is stopped while heating is continued using combustion gas from a kerosene burner.
Process Conditions: 985° C.; 1 atm; Process Time 50 minutes
Third Step Combustion Condition: 1,010° C.

COMPARATIVE EXAMPLE

Using the same equipment as in Example 1, gasification and combustion were tested for FRP (as shown in Table 1 above). The gasification conditions and test results for the conventional method are shown in Table 5. It is apparent from Table 5 that in the conventional method in which steam is not supplied, a large amount of tar and soot is generated, putting a large combustion load on the third step of the process.

TABLE 5

First Step (Operating Conditions)

Material: FRP 100 g/h
$H_2O/C$ = No steam supplied
$O_2$ Supply: $O_2/C$ = 0.3 (molar ratio)
Gasification Conditions: 776° C.; 1 atm; Process Time 20 minutes
(Results)

Produced Gas: 141 (NL/h)
Gas Composition (volume %): $H_2$ = 38; CO = 2; $CO_2$ = 57; $CH_4$ = 2
Residue from Incomplete Combustion: 6 g
(A large amount of tar and soot are produced during gasification.)
Second Step Stop supplying steam while heating using combustion gas from a kerosene burner.
Process Conditions: 1,005° C.; 1 atm; Process Time 50 minutes
Result: No residue from incomplete combustion is observed
Third Step Combustion Condition: 1,350° C.

EXAMPLE 3

Using the same equipment as in Example 1, gasification and combustion were tested for FRP (as shown in Table 1 above). Operating conditions and results are shown in Table 6. It is apparent from Table 6 that if the oxygen/carbon ($O_2/C$) molar ratio is maintained within an appropriate range and steam is supplied, no large amount of tar or soot is generated as gasification progresses.

TABLE 6

First Step (Operating Conditions)

Material: FRP 100 g/h
$H_2O/C$ = 1.3 (molar ratio)
$O_2$ Supply: $O_2/C$ = 0.3 (molar ratio)
Gasification Conditions: 760° C.; 1 atm; Process Time 20 minutes
(Results)

Produced Gas: 213 (NL/h)
Gas Composition (volume %): $H_2$ = 11; $N_2$ = 49; $CO_2$ = 39; $CH_4$ = 1
Residue from Incomplete Combustion: 6 g
Second Step Steam supply is stopped while heating is continued using combustion gas from a kerosene burner.
Process Conditions: 970° C.; 1 atm; Process Time 60 minutes
Result: No residue from incomplete combustion is observed
Third Step Combustion Condition: 1,070° C.

EXAMPLE 4

Using the same equipment as in Example 1, gasification and combustion were tested for FRP (all as shown in Table 1 above) and paper. Operating conditions and results are shown in Table 7. It is apparent from Table 7 that even for this mixed waste, the process incorporating the principles of the present invention gasifies waste without generating a large amount of tar or soot.

TABLE 7

First Step (Operating Conditions)

Material: FRP 100 g/h and Paper = 25 g/h
$H_2O/C$ = 1.3 (molar ratio)
Air Supply: $O_2/C$ = 0.5 (molar ratio)
Gasification Conditions: 735° C.; 1 atm; Process Time 20 minutes
(Results)

Produced Gas: 827 (NL/h)
Gas Composition (volume %): $H_2$ = O; $N_2$ = 68; $CO_2$ = 28; $CH_4$ = 4
Residue from Incomplete Combustion: 19 g
Second Step Steam supply is stopped while heating is continued using combustion gas from a kerosene burner.
Process Conditions: 980° C.; 1 atm; Process Time 60 minutes
Result: No residue from incomplete combustion is observed
Third Step Combustion Condition: 1,065° C.

From the above, it is clear that by utilizing the process incorporating the principles of the present invention, wherein waste containing organic substances which may be combusted or gasified by means of partial oxidation in the presence of air or oxygen and steam, the waste can be efficiently processed without discharging to the outside the system soot or tar left from carbon which is unreacted or incompletely combusted. In addition, a clean gasified gas containing little soot or tar can be obtained. The heat energy can be easily collected by burning such resulting gas.

(1) Properties of FRP waste product

There are waste products mainly with FRP resin and FRP from wasted FRP ships. FRP resin contains approximately 30–40 wt % glass fiber. FIG. 1 shows the analytical values.

| Category | FRP Resin | | | FRP From Wasted FRP Ships | | |
|---|---|---|---|---|---|---|
| FRP | 100.0 | 100.0 | 100.0 | 91.0 | 87.9 | 86.2 |
| (Resin) | (69.3) | (64.6) | (62.5) | (63.0) | (80.0) | (55.2) |
| (Glass Fiber) | (30.7) | (35.4) | (37.5) | (28.0) | (27.9) | (31.0) |
| Wood | | | | 8.0 | 7.8 | 7.0 |
| Others (sand, metals) | | | | 1.0 | 4.5 | 6.8 |

(2) The optimum region of gasification temperature is approximately 650–750° C. Below are restrictions for FRP waste products.

(a) Process below fusion temperature (approximately 840° C.) of glass fiber.

(b) A region without unreacted carbon: Apply restrictions on oxygen doping ratio $O_2/C$, steam doping ratio $H_2O/C$ (see FIG. 1).

(c) A region without heavy hydrocarbons (hard to combust heavier than $C_6$): With the operational result (● ■ ▲ in FIG. 1) along with considerations of the above, optimum operational region with attentions on operational accuracy and allowance is _____ in FIG. 1.

With regard to FRP (glass fiber-reinforced plastics), the following points should be noted:

FRP contains approximately 30–40 wt % glass, and the melting point of the glass is about 780° C. That is, if FRP is treated at a temperature above the glass-melting temperature, incomplete gasification can result in some sections thereof, since the liquefied glass can cover parts of the organic waste.

Aromatic organic compounds exist in the FRP resins. There is the possibility that chlorine found in sea water (such as from sodium chloride [NaCl] and magnesium chloride [$MgCl_2$]) might react with the aromatic compounds which did not gasify to form dioxin.

Consequently, a preferred range of temperatures for gasification of FRP is between about 650° C. and 750° C.

A further aspect follows. If complete gasification occurs under partial oxidation conditions at temperatures between about 650–750 ° C., then there are no incompletely decomposed aromatic hydrocarbons. However, if not all the aromatic hydrocarbons are decomposed, their decomposition takes place subsequently by heat treatment in the presence of air or oxygen or both at temperatures between about 700–1000° C.

Figure 2:
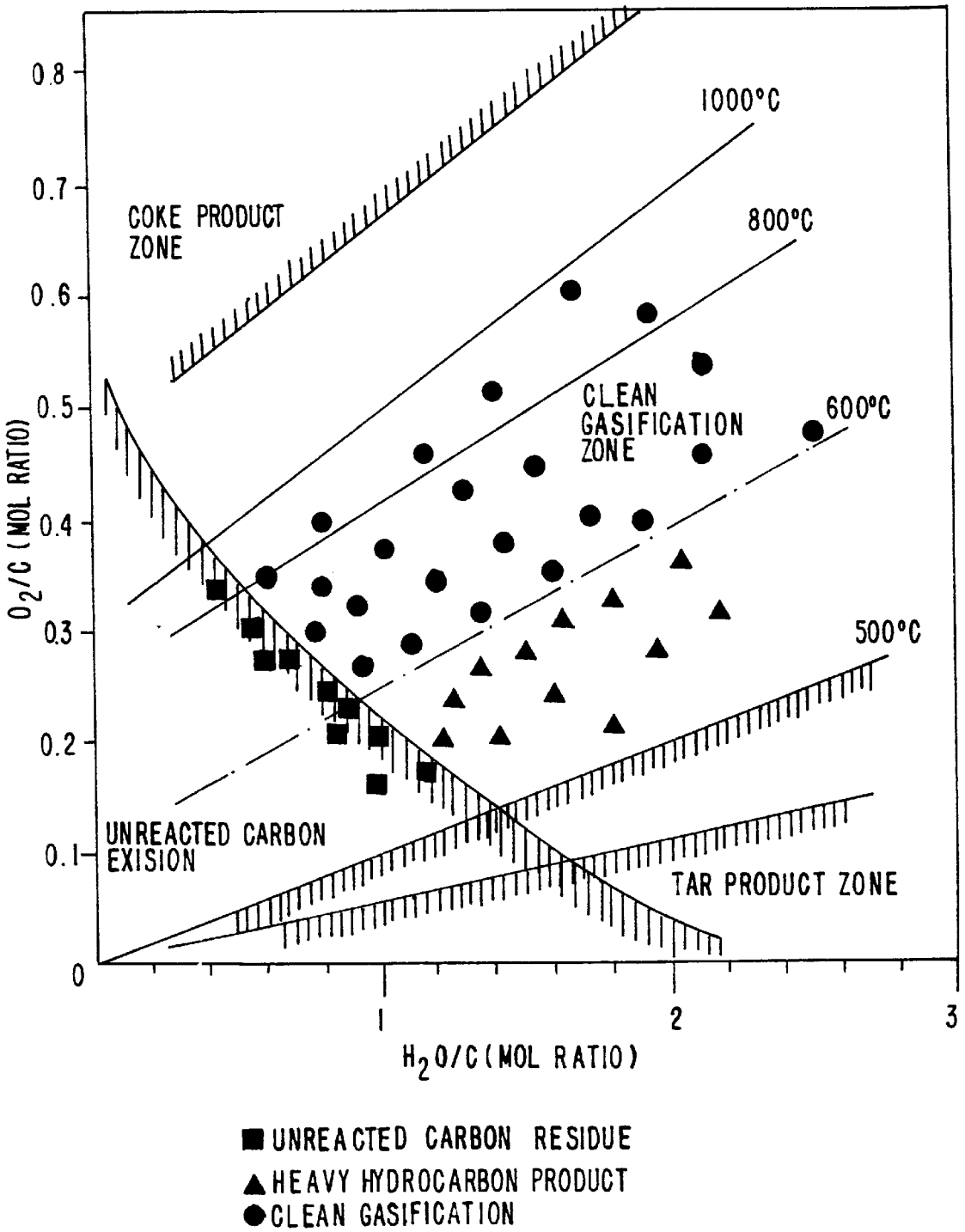
FIG. 2 shows the polyethylene gasification properties.
Figure 3:
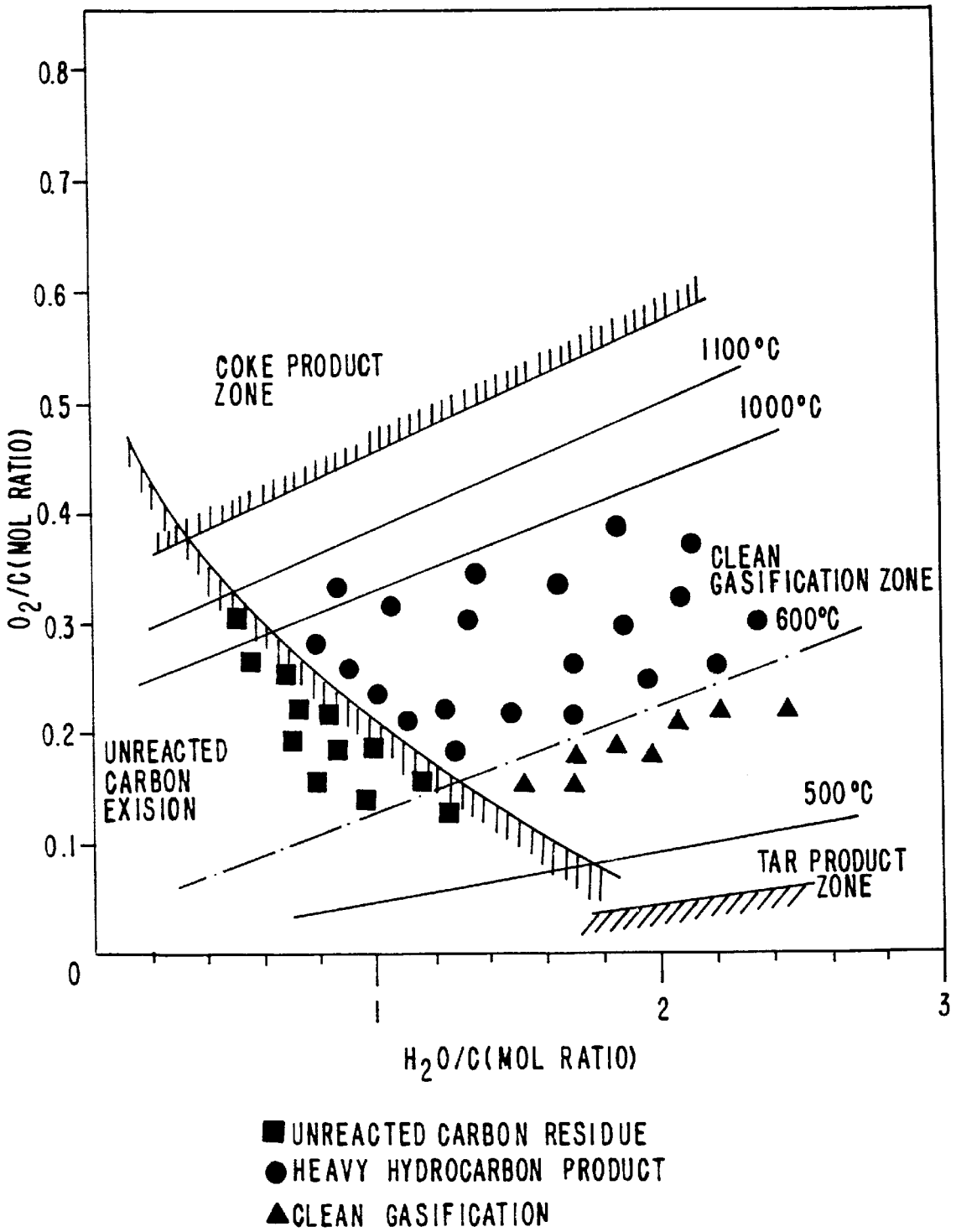
FIG. 3 shows the polystyrene gasification properties.
Figure 4:
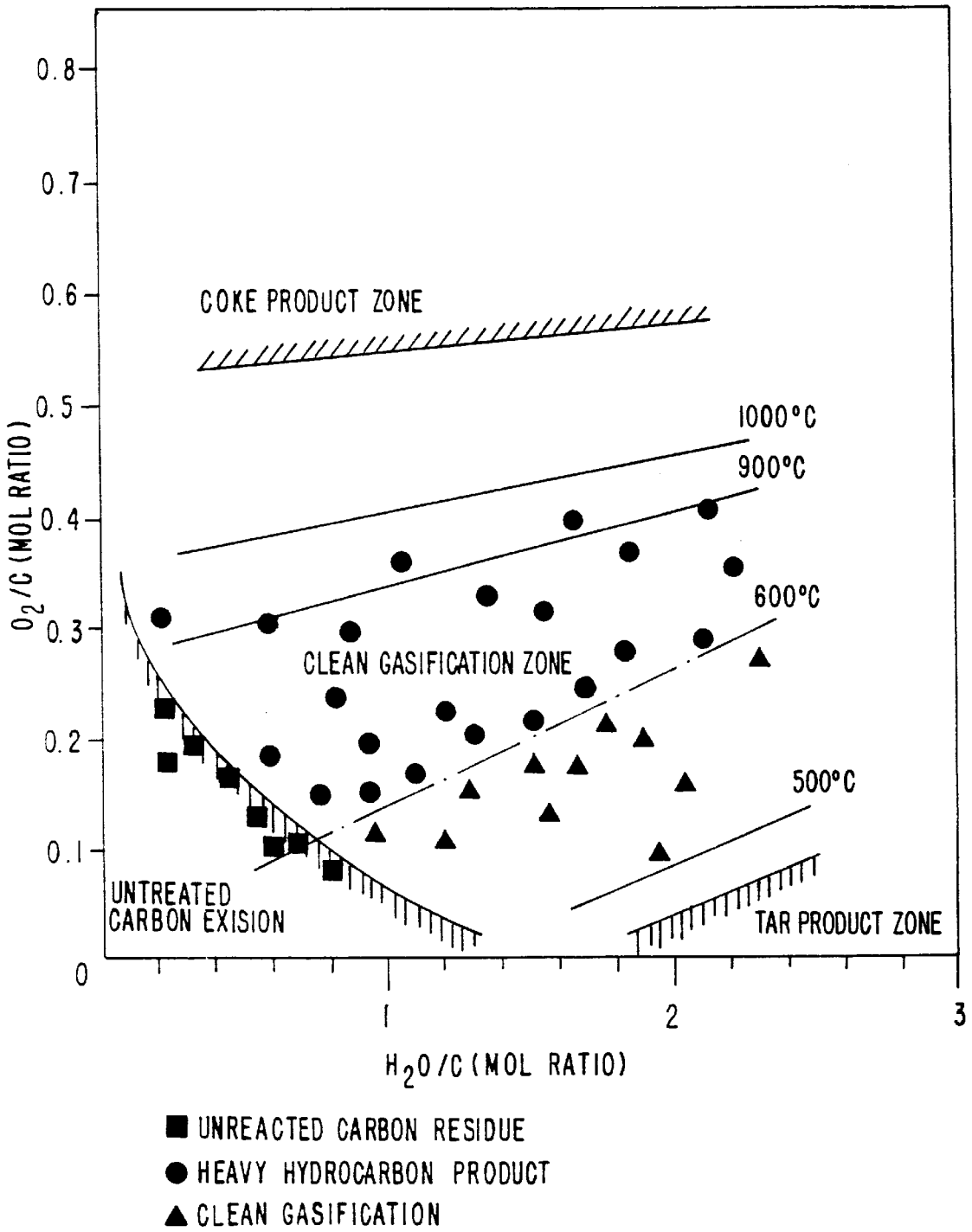
FIG. 4 shows the polyvinyl chloride gasification properties.

As can be seen from the FIGS. 2, 3, and 4, gasification treatments of polyethylene, polystyrene, and polyvinyl chloride offer similar results to those obtained by treatment of FRP as shown in FIG. 1.

Various modifications will become apparent for those skilled in the art after receiving the teachings of the present disclosure without departing from the scope thereof and, therefore, the scope of the present invention is intended to be limited only by the appended claims.

What is claimed is:

1. A waste treatment process for gasifying waste containing organic substances comprising the steps of:

supplying steam and air or oxygen to the waste to be treated;

partially oxidizing any portion of said waste which is easily thermally decomposed in the presence of said steam; and discontinuing the supply of steam while continuing to supply air or oxygen to combust the remaining combustibles having carbon as their major component.

2. A process, as claimed in claim 1, wherein said partial oxidation is carried out by heating said waste at a desired temperature.

3. A waste treatment process for gasifying waste containing organic substances which may be combusted or gasified by partial oxidation in the presence of air or steam, said process comprising the steps of:

supplying steam and air or oxygen to the waste to be treated;

adjusting the molar ratio of steam/carbon ($H_2O/C$) for the supplied steam and the organic substances containing carbon to be substantially between 1 and 10;

partially oxidizing said organic substances at a temperature substantially between 700° C. and 900° C.; and discontinuing the supply of steam while continuing to supply air or oxygen to combust the remaining combustibles having carbon as their major component.

4. A waste treatment process, as claimed in claim 3, including the additional step of combusting any flammable gases generated during the gasification in the presence of air or oxygen.

5. A waste treatment process, as claimed in claim 4, wherein said additional step is carried out in a separate environment from that of the partial oxidation and steam discontinuation steps.

6. A waste treatment process, as claimed in claim 4, wherein said additional step is carried out at a temperature substantially between 1000° C. and 1300° C.

7. A waste treatment process, as claimed in claim 5, wherein said additional step is carried out at a temperature substantially between 1000° C. and 1300° C.

8. A process according to claim 2, wherein the temperature is between 650–750° C.

9. A process according to claim 1, wherein the waste materials are selected from the group consisting of fiber-reinforced plastics, polyethylene, polystyrene, and polyvinyl chloride.

10. A process according to claim 3, wherein the waste materials are selected from the group consisting of fiber-reinforced plastics, polyethylene, polystyrene, and polyvinyl chloride.

* * * * *